United States Patent [19]

Swanson

[11] Patent Number: 4,926,672

[45] Date of Patent: May 22, 1990

[54] PIPE BENDER

[75] Inventor: Melvin E. Swanson, Hayesville, N.C.

[73] Assignee: Lidseen of North Carolina, Inc., Hayesville, N.C.

[21] Appl. No.: 346,985

[22] Filed: May 3, 1989

[51] Int. Cl.[5] ..... B21D 7/04

[52] U.S. Cl. ..... 72/458; 72/157; 72/459; 72/482

[58] Field of Search ..... 72/138, 482, 457, 458, 72/459, 157, 159

[56] References Cited

U.S. PATENT DOCUMENTS

| | | | |
|---|---|---|---|
| 1,650,955 | 11/1927 | Miller | 72/459 |
| 1,835,264 | 12/1931 | Blythe | 72/157 |
| 1,859,406 | 5/1932 | Meighan | 72/459 |
| 1,899,281 | 2/1933 | Lidseen . | |
| 1,949,938 | 3/1934 | Martin . | |
| 2,695,538 | 11/1954 | Parker . | |
| 2,864,272 | 12/1958 | Swanson . | |
| 3,147,792 | 9/1964 | Hautau . | |
| 3,172,452 | 3/1965 | Bryant | 72/458 |
| 3,336,779 | 8/1967 | Schall | 72/459 |
| 3,417,590 | 12/1968 | Ensley | 72/157 |
| 4,546,632 | 10/1985 | Van Den Kieboom et al. | 72/158 |

FOREIGN PATENT DOCUMENTS

| | | | |
|---|---|---|---|
| 0470314 | 8/1937 | United Kingdom | 72/459 |
| 2051632 | 1/1981 | United Kingdom | 72/458 |

*Primary Examiner*—David Jones

*Attorney, Agent, or Firm*—Bell, Seltzer, Park & Gibson

[57] ABSTRACT

The invention comprises an improved pipe bender for accommodating multiple pipes of varying diameters and sidewall thicknesses and bending sections of them into an arcuate form without deforming or collapsing the sidewalls of the pipe. The pipe bender comprises a mounting base; an axle supported by the mounting base and having end portions that protrude from respective opposite sides of the mounting base; two sheave blocks having arcuate pipe receiving channels, one such sheave block mounted on each protruding end portion of the axle for rotation about the axis of the axle; first and second pipe engaging mechanisms for engaging and holding pipe; and a device for rotating the sheave blocks about the axis of the axle so that a pipe positioned in a pipe receiving channel is bent into an arcuate form corresponding to that of the respective pipe receiving channel. Each of the oppositely mounted sheave blocks cooperate with one another such that the bending moments about the axis of the axle which result from the force required to bend a pipe so substantially offset one another to thereby reduce the likelihood of shearing the axle from the mounting base.

9 Claims, 3 Drawing Sheets

PIPE BENDER

FIELD OF THE INVENTION

The present invention relates to benders for flexible metal pipe such as electrical conduit, and in particular relates to a pipe bender for accommodating multiple pipes having varying diameters and sidewall thicknesses for bending sections of them into an arcuate form, thereby producing a preselected angle without deforming or collapsing the sidewalls.

BACKGROUND OF THE INVENTION

In the construction industry, tubular metal conduit frequently is used to provide a protective sheathing for electrical wiring. Typically, such conduit is used to route the wiring between junctions. To accommodate specific requirements of construction jobs and to carry wire between desired locations, the conduit must conform to walls and other architectural features and also circumvent obstacles. Because stock conduit typically is provided in linear portions, it often must be bent into various shapes to suit these purposes; however, when bending the conduit, it is important to avoid collapsing, crimping or deforming the conduit sidewalls to preserve the lumen within. This is necessary to prevent forming obstructions or restrictions in the conduit which might impede electrical wires or other objects which must pass through it and to avoid creating breaks or sharp angles in the conduit's interior surfaces. Such flaws must be avoided as they could cut or otherwise damage insulated wiring and result in fire or electrical hazards.

Electricians and construction workers frequently find it necessary to use many different sizes of conduit in any given construction project. In some instances, small conduit may be needed to carry relatively few wires through a narrow or tightly restricted area. In another application, however, an electrician may find that he needs to use a large diameter section of conduit to accommodate a large number of wires. In recognition of this need, commercial manufacturers provide electrical conduit in several standard sizes having various diameters and sidewall thicknesses. Each type of conduit has different bending properties which define the radius through which the conduit must be bent for satisfactory results. If bent too sharply, the conduit sidewalls will deform, causing buckling and possibly collapsing the conduit. One portion of conduit having a particular outside diameter but thick sidewalls will require bending at a different radius than another portion having the same diameter but thin sidewalls. In general, thin wall conduit must be bent into a curve having a radius that is greater than that permitted for rigid, or thick wall conduit, since thin wall pipe will buckle if it is bent through the smaller radius specified for rigid wall conduit. Thus, it is desirable that a pipe bender be versatile to accommodate the requirements of each type of conduit.

Pipe benders have been developed which have bending means specifically designed for each type of conduit. Typically, this has been accomplished by using an arcuate pipe receiving channel which conforms to the outside surface of conduit and which is formed into the radius required for bending one specific type of conduit. This type of pipe bender requires a different pipe receiving channel for bending each type and size of conduit. Also, to save time, effort, and expense, it is desireable that a single pipe bender be capable of bending many different sizes and types of conduit. Additionally, since electricians frequently wish to bend multiple sections of conduit simultaneously to expedite their work and to bend uniform sections of conduit which must be routed parallel to each other, it is desirable that a pipe bender have this capacity as well. These requirements have resulted in pipe benders having multiple pipe receiving channels, adaptations for different conduit sizes and wall thicknesses, and the capacity to bend multiple sections of pipe simultaneously. As enumerated below, however, certain limitations or otherwise undesirable characteristics historically have accompanied the incorporation of such improvements into pipe benders.

Pipe benders having multiple pipe receiving channels have been described in the following patents: Lidseen, U.S. Pat. Nos. 1,899,281; Parker, 2,695,538; Miller, 1,650,955; Martin, 1,949,938; Hautau, 3,147,792; and Van Den Kieboom, et al., 4,546,632.

The Lidseen '281 patent particularly relates to the type of portable conduit bender to which the present invention pertains. This patent shows a pipe bender arrangement having a single sheave block with three pipe receiving channels, all mounted on an axle protruding from one side of a mounting base. As a practical matter, such an arrangement is limited in its applications. Increasing the number of pipe receiving channels on the sheave block can be done only by adding additional pipe receiving channels to the outboard side of the rotatable sheave block. This increases the distance along the axle from the thus added pipe receiving channel to the mounting plate, so that when pipe is bent around such distal pipe receiving channels, the bending moment can become so great as to cause undue stresses at the juncture of the axle and the mounting plate. Such stresses can be damaging or destructive to the pipe bender, and in the past they have caused bending or even fracturing of the mounting plate through which the axle passes since they tend to "rip out" the sleeve or bearing supporting the axle. As a result, the sheave block of the Lidseen '281 arrangement cannot practically accommodate more than three pipe receiving channels.

In an attempt to overcome this inherent limitation, pipe benders of the type shown in the Lidseen '281 patent have been adapted to accept interchangeable pipe receiving channels which can be removed and replaced as desired for bending different types of sizes of pipe. Although the interchangeable pipe receiving channels increase somewhat the versatility of the pipe bender, their use necessarily incorporates the time consuming exercise of manually changing the pipe receiving channels. This interrupts the electrician's work, impedes the progress of the construction job, and decreases overall productivity.

In light of the aforementioned deficiencies, it is an object of the present invention to provide a new arrangement for a pipe bender which can accommodate a greater number of conduit sizes and types without relying on interchangeable pipe receiving channels and which can bend a greater number of pipes simultaneously.

SUMMARY OF THE INVENTION

The invention comprises an improved pipe bender for accommodating multiple pipes of varying diameters and sidewall thicknesses and bending sections of them into an arcuate form without deforming or collapsing the sidewalls of the pipe. The pipe bender comprises a mounting base; an axle supported by the mounting base and having opposite end portions that protrude from respective opposite sides of the mounting base; a sheave block mounted on each protruding end portion of the axle for rotation about the axis of the axle, each sheave block including a plurality of arcuate pipe receiving channels adapted for receiving pipes therein; first pipe engaging means carried by each of said sheave blocks for engaging and holding pipe at a first location along its length when positioned in a pipe receiving channel; second pipe engaging means carried by the mounting base and positioned for engaging and holding pipe at a second location longitudinally spaced from the first location; and means for rotating the sheave blocks. Each of the oppositely mounted sheave blocks cooperate with one another such that the bending moments about the axis of the axle which result from the force required to bend a pipe substantially offset one another to thereby reduce the likelihood of shearing the axle from the mounting base.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments, and wherein.

DESCRIPTION OF THE PREFERRED EMBODIMENT

Figure 1:
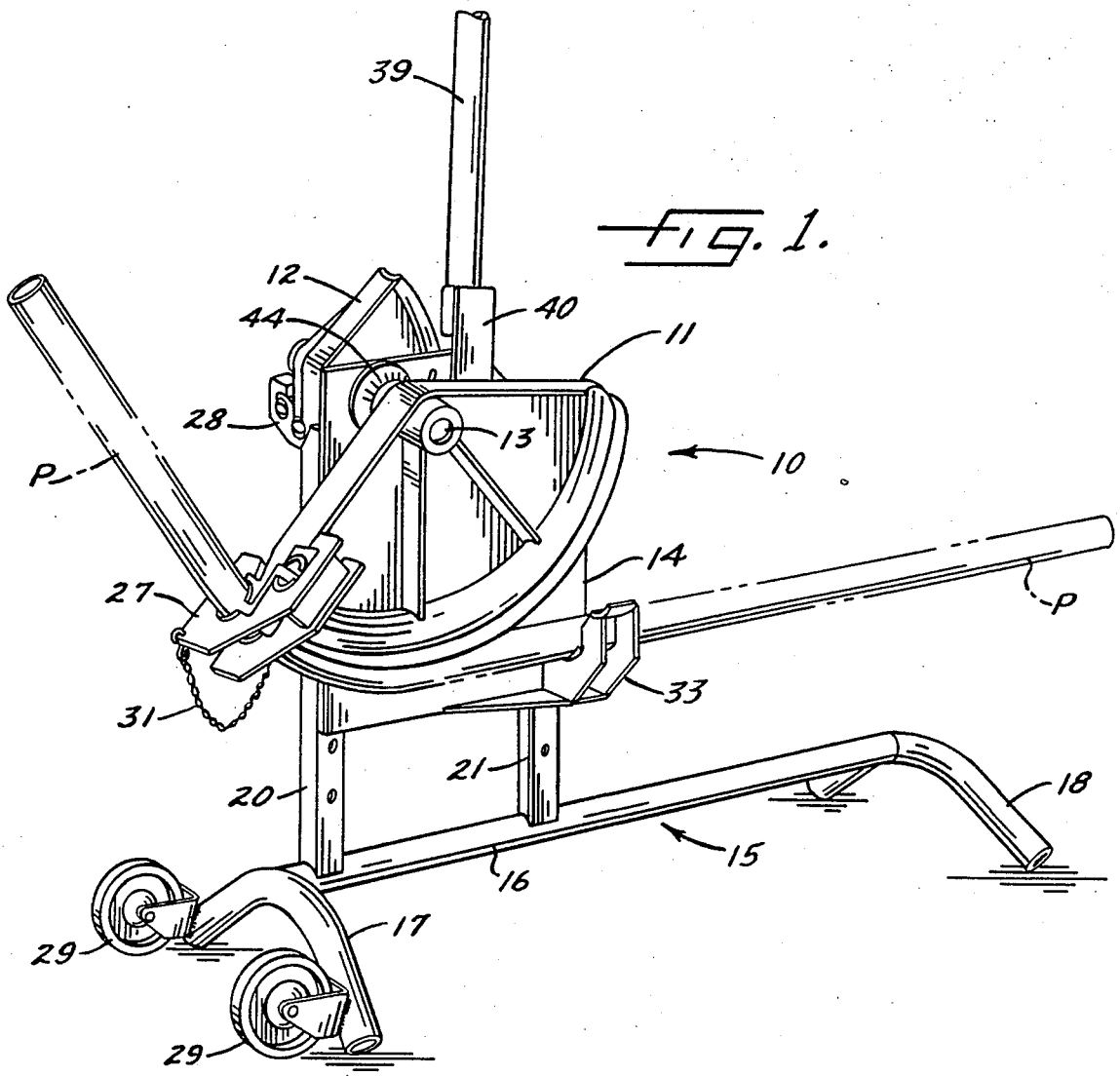
FIG. 1 is a perspective view of a pipe bender in accordance with the present invention, with the pipe receiving channels positioned to illustrate a partially bent pipe.
Figure 2:
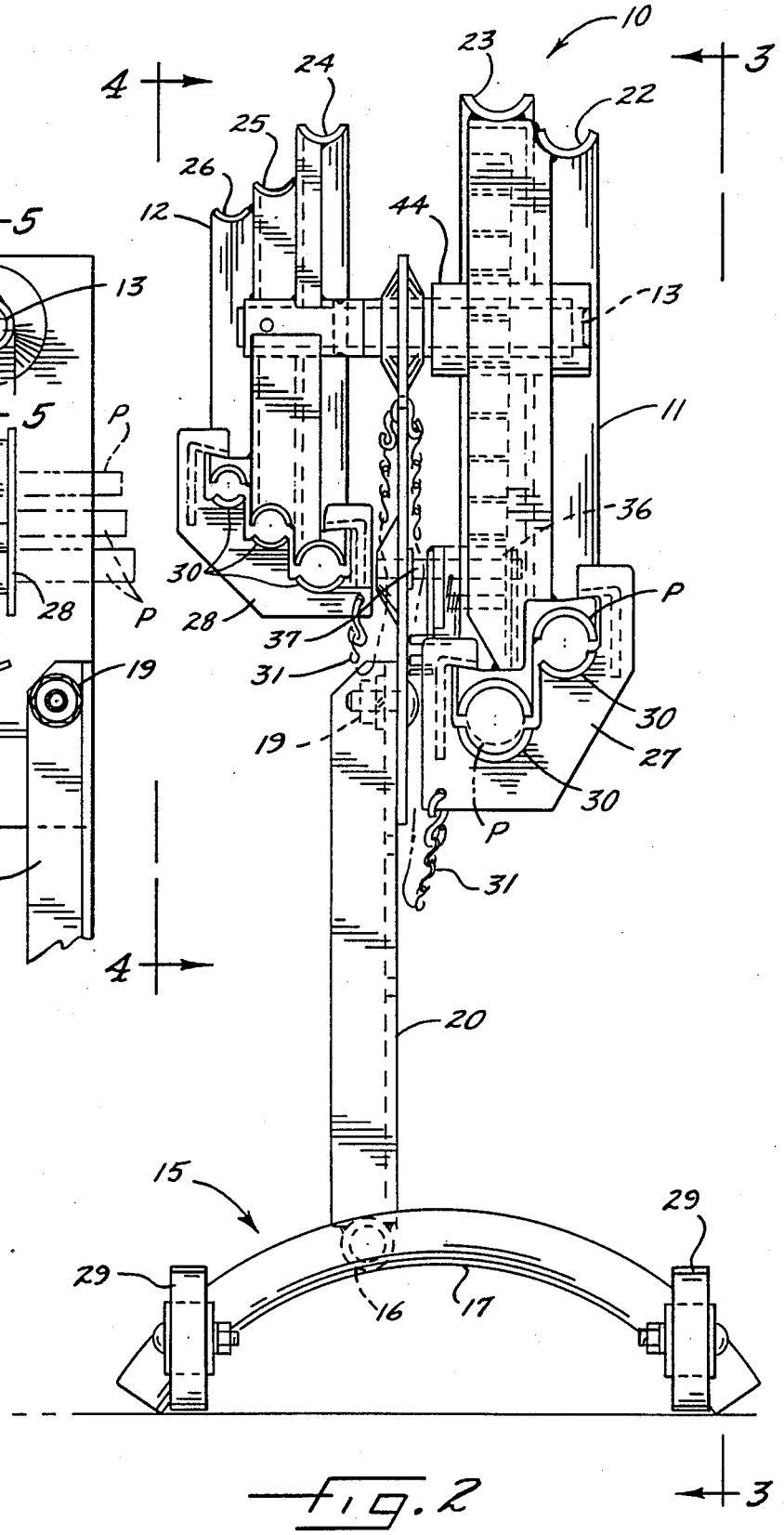
FIG. 2 is a front elevational view of the pipe bender of FIG. 1.

Referring now to the drawings, FIGS. 1 and 2 show an improved pipe bender broadly designated at 10 constructed in accordance with the principles of the present invention. The pipe bender includes two sheave blocks 11 and 12 which are rotatably mounted on an axle 13. In the preferred embodiment, the axle 13 is horizontal and passes through a plate 14 which is supported in a vertical position by a mounting base broadly designated at 15. The mounting base 15 includes a tubular center member 16 to which front and rear tubular cross members 17 and 18, respectively, are attached. The cross members 17 and 18 are curved so that each end thereof rests on the ground surface to firmly support the pipe bender. A pair of vertical struts 20 and 21 are welded t o interior portions of the center member 16 and extend upwardly therefrom to provide support to the plate 14. The forward and rearward edges of the plate 14 are securely fixed to the vertical struts 20 and 21 by the bolts 19 (FIG. 2). The mounting base 15 also carries a pair of wheels 29 so that the pipe bender 10 can be more easily moved from place to place.

The sheave blocks 11 and 12 are rotatable about axle 13 in a substantially vertical plane The periphery of the sheave blocks 11 and 12 are formed into a plurality of arcuate pipe receiving channels. Five of these are present in the illustrated embodiment and designated at 22, 23, 24, 25 and 26. The channels on each sheave block are axially offset from one another along the axis of the axle 13. A first pipe engaging means shown as the clamp 27 is carried by sheave block 11 and a corresponding clamp 28 is carried by sheave block 12. Clamps 27 and 28 have protruding portions which releasably engage and grasp the forward edges of the outermost portions of the sheave blocks 11 and 12, respectively. A plurality of channels 30 are formed in the interior surface of clamps 27 and 28 to cooperate with the arcuate pipe receiving channels 22–23 and 24–26, respectively, such that when clamps 27 and 28 engage sheave blocks 11 and 12, channels 30 align with the pipe receiving channels 22–26 to define a plurality of circular perimeters, each of which approximates the outer diameter of a particular size of pipe. Respective chains 31 connect the clamps 27 and 28 to plate 14 to prevent potential loss of the clamps 27 and 28 when they are not engaged to the sheave blocks 11 or 12.

Figure 5:
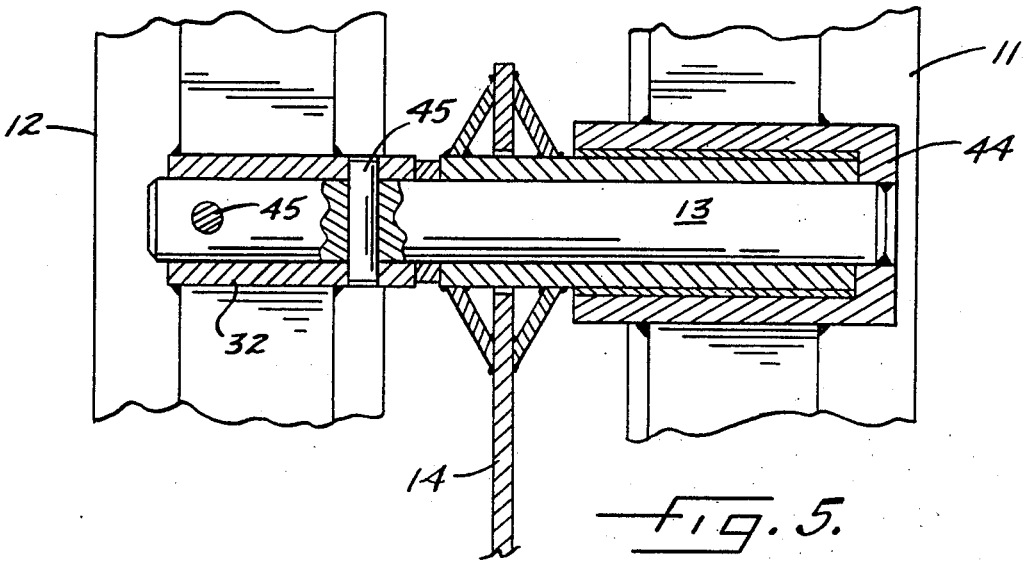
FIG. 5 is a cross-sectional view of the portion taken along lines 5—5 of FIG. 4.

As best seen in FIGS. 2 and 5, the axle 13 passes through a sleeve 32 affixed to the plate 14. The sheave blocks 11 and 12 encapsulate each end of the axle 13 and are fixedly mounted thereto by means of set screws, welding, or other appropriate means. In FIG. 5, sheave block 11 is mounted on the sleeve 32 using a collar 44 while sheave block 12 is mounted using the set pins 45. The sleeve 32 supports the weight of the axle 13 and of the sheave blocks 11 and 12, and it provides a bearing surface upon which the axle 13 may rotate.

Figure 4:
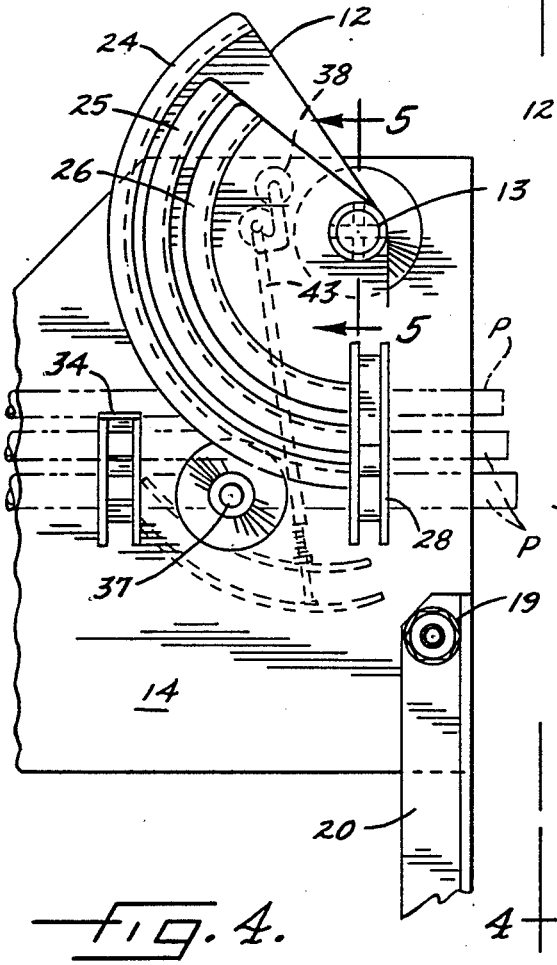
FIG. 4 is a partial side elevational view taken along lines 4—4 of FIG. 2.
Figure 3:
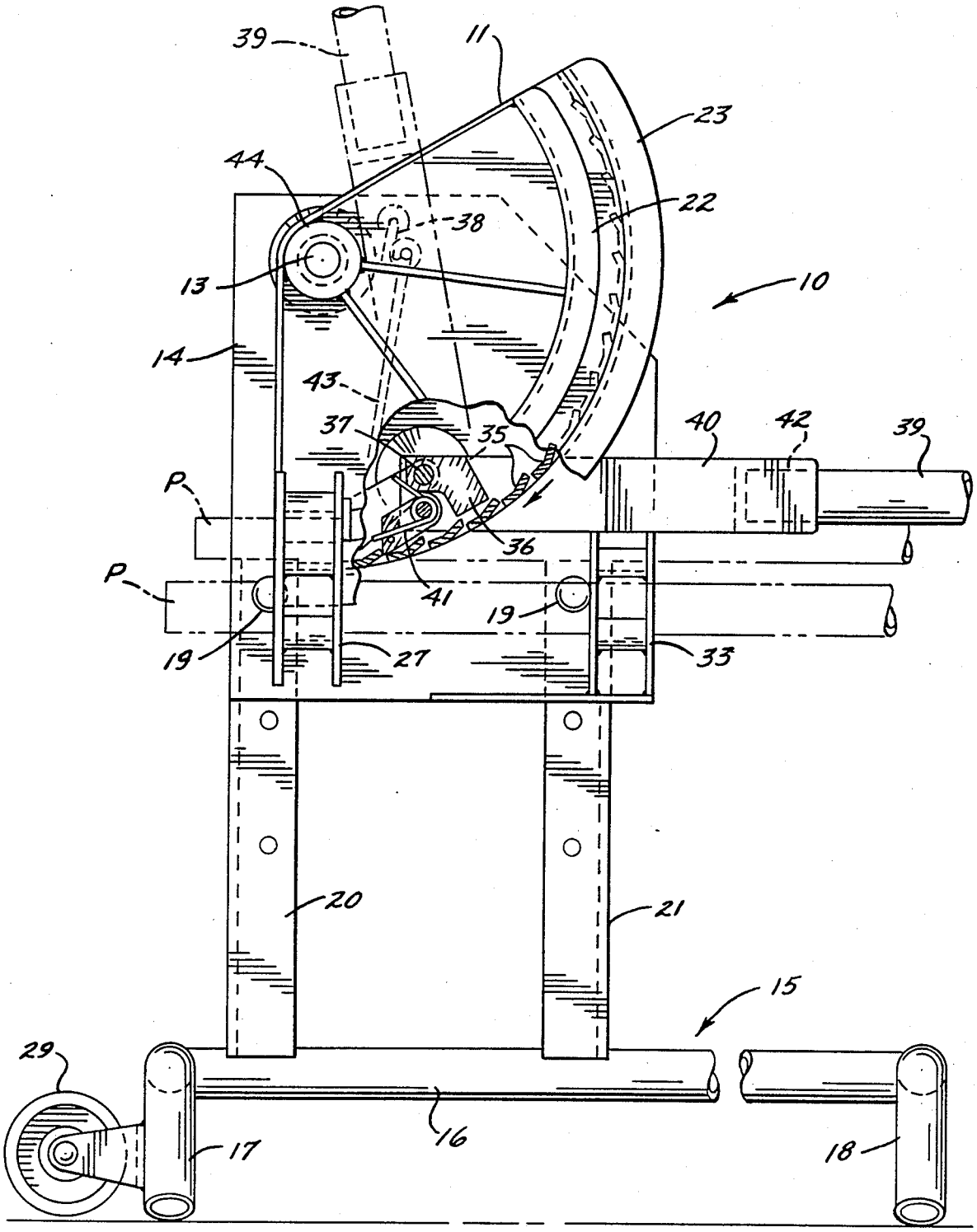
FIG. 3 is a partially cut away side elevational view taken along lines 3—3 of FIG. 2.

FIG. 1 also illustrates a second pipe engaging means 33 that extends horizontally from the lower rearward edge of the mounting plate 14 at a position longitudinally spaced from the clamp 27. The upper surface of the pipe engaging means 33 is formed into a plurality of concave shapes that correspond to and are positioned in alignment with the pipe receiving channels 22–26. These concave surfaces conform to the lower sides of pipes inserted into the pipe receiving channels that are collinear to them, as can be seen most clearly in FIGS. 1, 3 and 4. A pipe engaging means 34 (FIG. 4) is similarly positioned on the mounting plate 14 on the opposite side from the pipe support means 33.

The invention further comprises means for rotating the sheave blocks 11 and 12 about the axis of the axle 13. As can be seen most clearly in FIG. 3, a plurality of ratchet teeth 35 line the interior surface of the sheave block 11. A pawl assembly 36 is also located in the space within sheave block 11 and positioned on the plate 14 so as to engage the ratchet teeth 35. A support member 37 extends from the plate 14 to provide a pivotal mounting for a lever 40 which operates the pawl assembly 36. This arrangement allows the lever 40 to rotate in a vertical plane. The pawl assembly 36 is also attached to the lever 40 near its pivot point on the support member 37. A spring 41 acts on the pawl assembly 36 and urges it to maintain its lower and front surfaces in contact with the ratchet teeth 35. In this arrangement, when the lever 40 is raised, the pawl assembly 36 moves rearwardly to engage one of the ratchet teeth 35. When the lever 40 is then rotated downwardly, the leading edge of the pawl assembly 36 engages one face of one of the ratchet teeth 35 to exert a forward force thereon that rotates sheave blocks 11 and 12. In the preferred embodiment, the lever 40 includes means shown as the handle-receiving opening 42 for receiving an extension or handle 39 that increases the mechanical advantage on the lever 40 available to an operator of the pipe bender. Also, a disengagement mechanism shown as the rod 43, is actuated by an operator pulling a handle 38 on the upper portion thereof, and raises the pawl assembly 36 to remove it from engagement with the ratchet teeth 35. Disengagement of the pawl assembly 36 from the ratchet teeth 35 permits the sheave blocks 11 and 12 to freely rotate backwards towards their original position at which pipes may be inserted.

When it is desired to bend a section of a pipe, an operator inserts a pipe so that it passes above pipe engaging means 33 or 34 and beneath the pipe receiving channel of the appropriate size to conform to the outer diameter of the pipe and of the proper arc specified for bending pipe of that type. Various pipes P are illustrated by the broken line drawing. Clamp 27 or 28 is then brought into engagement with the respective sheave block beneath which the pipe has been inserted so that channel 30 conforms to the underside of the pipe and supports it in a position adjacent to the appropriate pipe receiving channel. As best illustrated in FIG. 2, in the preferred embodiment, the sheave block 11 can accept up to two pipes for simultaneous bending, and sheave block 12 can accept up to three pipes for simultaneous bending. As many as five pipes may be bent simultaneously by using both sheave blocks. Just as importantly, at least five different sizes of pipe can be bent in the bender 10 without changing any of its fittings.

Once a pipe has been engaged by the pipe bender 10 in the foregoing manner, the lever 40 is then reciprocatingly moved in a vertical plane to actuate the pawl assembly 36 and the ratchet teeth 35, thereby rotating sheave blocks 11 and 12 as the lever 40 is operated. Because a first section of pipes passing between the clamps 27 and 28 and the pipe receiving channels are restrained, rotation of sheave blocks 11 and 12 forces the pipes to bend around the pipe receiving channel in which they are placed and into a resulting curved shape. Meanwhile, the pipe engaging means 33 and 34 restrain the underside of a second section of the pipes from moving in response to the movement of the first section of the pipe. In this manner, rotation of sheave blocks 11 and 12 bend the pipes to a desired angle, as indicated by a vernier scale 44 on the outer surface of the sleeve 32. After bending, disengagement mechanism 43 is actuated, freeing sheave blocks 11 and 12 for rearward rotation and relieving the stress imposed by the pipes. This permits the clamps 27 and 28 to be removed from sheave blocks 11 and 12 to free the bent pipes for removal from the pipe bender.

The addition of sheave block 12 to the extended portion of axle 13 on the side of mounting plate 14 opposite to sheave block 11 increases the strength of the pipe bender 10 by providing a counterbalancing force while pipes are being bent. The advantages of this improvement are most clearly illustrated in FIG. 2. When pipes are bent around sheave block 11, a downward force is exerted on the axle 13. The weight of sheave block 12 on the opposite side of the mounting plate 14 likewise creates a downward load on the axle 13 which opposes the bending moment created by the pipes being bent in sheave block 11. Likewise, if pipes are bent in sheave block 12, the weight of sheave block 11 opposes the bending moment created by the pipes being bent in sheave block 12. If pipes are bent in sheave blocks 11 and 12 simultaneously, the downward forces generated by bending the pipes around each sheave block 11 and 12 oppose each other. Thus, these opposing forces create bending moments which substantially offset each other at the point where axle 13 passes through plate 14. This arrangement substantially minimizes the bending stresses imposed on axle 13 and sleeve 32, thereby preventing overloading of the pipe bender and reducing the likelihood of shearing the axle 13 from mounting plate 14 or causing other damage to sleeve 32.

Just as importantly, this arrangement increases the number of pipe receiving channels which can be proximately located to plate 14. This minimizes the length of the moment arm alOng the axis of axle 13 when multiple bending shoes are used: thus, this arrangement minimizes the effective bending moment at sleeve 32 and plate 14 when pipes are bent.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which is claimed:

1. An improved pipe bender for accommodating multiple pipes of varying diameters and bending sections of them into an arcuate form, said pipe bender comprising:

a mounting base;

an axle supported by said mounting base and having opposite end portions which protrude from respective opposite sides of said mounting base;

a pair of sheave blocks, one of which is mounted on each protruding end portion of said axle on each respective opposite side of said mounting base for rotation about the axis of the axle on said opposite sides of said mounting base, each said sheave block including a plurality of arcuate pipe receiving channels adapted for receiving respective pipes therein, the pipe receiving channels on each sheave block being axially offset from one another along its length when positioned in a pipe receiving channel; first pipe engaging means carried by each of said sheave blocks and cooperating with said pipe receiving channels for engaging and holding pipe at a first location along its length when positioned in a pipe receiving channel;

first pipe engaging means carried by each of said sheave blocks and cooperating with said pipe receiving channels for engaging and holding pipe at a first location along its length when positioned in a pipe receiving channel;

second pipe engaging means carried by said mounting base on each of said opposite sides thereof and positioned for engaging and holding pipe at a second location longitudinally spaced from said first location;

means for rotating said sheave blocks about the axis of said axle so that a pipe which is positioned in one of said pipe receiving channels is bent into an arcuate form corresponding to that of the respective pipe receiving channel;

and wherein the opposingly mounted sheave blocks cooperate with one another such that the bending moments about the axis of said axle which result from the force required to bend a pipe substantially offset one another to thereby reduce the likelihood of shearing the axle from said mounting base.

2. The pipe bender of claim 1 wherein said means for rotating said sheave blocks comprises a leveraged ratchet and pawl mechanism.

3. The pipe bender of claim 2 wherein said leveraged ratchet and pawl mechanism comprises ratchet teeth positioned along the interior circumference of at least one of said sheave blocks and a pawl operatively mounted on said mounting base.

4. The pipe bender of claim 1 wherein said arcuate pipe receiving channels have different radii for concurrently accommodating and bending a plurality of pipes having various diameters and sidewall thicknesses.

5. The pipe bender of claim 1 wherein said arcuate pipe receiving channels have different depths for accommodating pipe of various diameters.

6. The pipe bender of claim 1 further comprising a cylindrical sleeve extending perpendicularly through said mounting base for rotatably supporting said axle.

7. The pipe bender of claim 1 wherein said first pipe engaging means comprises a clamp having concave channels formed therein and that releasably engages each said sheave block for grasping and maintaining a pipe between said clamp and said pipe receiving channel.

8. The pipe bender of claim 1 wherein said second pipe engaging means include curved surfaces that conform to the cylindrical shape of pipe for thereby restraining a pipe without deforming or collapsing it while it is bent.

9. An improved pipe bender for accommodating multiple pipes of various diameters and bending sections of them into an arcuate form, said pipe bender comprising:

a mounting base;

a vertically disposed plate supported by said mounting base;

a horizontal sleeve perpendicularly disposed in said plate;

an axle supported by said sleeve, having opposite end portions that protrude from respective opposite sides of said sleeve;

a sheave block mounted on each protruding end portion of said axle for rotation about the axis of the axle, each said sheave block including a plurality of arcuate pipe receiving channels adapted for receiving respective pipes therein and having different radii for concurrently accommodating and bending a plurality of pipes having various diameters and sidewall thicknesses, said pipe receiving channels on each sheave block being axially offset from one another along the axis of said axle;

a clamp releasably engaged to each of said sheave blocks and cooperating with said pipe receiving channels for engaging and holding pipe at a first location along its length when positioned in a pipe receiving channel;

pipe engaging means carried by said plate and positioned for engaging and holding pipe within curved surfaces that conform to the cylindrical shape of pipe for engaging and holding pipe at a second location longitudinally spaced from said first location;

a leveraged ratchet and pawl mechanism having ratchet teeth positioned along the interior circumference of at least one of said sheave blocks and a pawl operatively mounted on said plate pipe which is positioned in one of said pipe receiving channels is bent into an arcuate form corresponding to that of the respective pipe receiving channel;

and wherein the opposingly mounted sheave blocks cooperate with one another such that the bending moments about the axis of said axle which result from the force required to bend a pipe substantially offset one another to thereby reduce the likelihood of shearing the axle from said mounting plate.

* * * * *